US008752890B2

(12) United States Patent
Murphy et al.

(10) Patent No.: US 8,752,890 B2
(45) Date of Patent: Jun. 17, 2014

(54) RECLINING SEATING UNIT WITH EXTENDABLE FOOTREST

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 400 days.

(21) Appl. No.: 13/157,528

(22) Filed: Jun. 10, 2011

(65) Prior Publication Data

US 2012/0104827 A1 May 3, 2012

Related U.S. Application Data

(60) Provisional application No. 61/409,659, filed on Nov. 1, 2010, provisional application No. 61/479,104, filed on Apr. 26, 2011.

(51) Int. Cl.
*A47C 1/034* (2006.01)
*A47C 7/50* (2006.01)

(52) U.S. Cl.
USPC ..... 297/85 L; 297/423.35

(58) Field of Classification Search
USPC ..... 297/85 L, 423.34, 423.35
See application file for complete search history.

(56) References Cited

U.S. PATENT DOCUMENTS 2,843,183 A 7/1958 Luckhardt
2,843,184 A 7/1958 Lorenz
2,869,619 A 1/1959 Petersen et al.
2,984,293 A 5/1961 Bontempi et al.
2,996,332 A 8/1961 Kurtyka et al.
3,021,098 A 2/1962 Spound
3,057,657 A 10/1962 Fletcher
3,074,758 A 1/1963 Schliephacke
RE25,375 E 4/1963 Lorenz (Continued)

FOREIGN PATENT DOCUMENTS

DE 26 01 691 A1 7/1977

OTHER PUBLICATIONS

The International Search Report and Written Opinion for PCT/US2008/010721, dated Sep. 15, 2008.

*Primary Examiner* — David R Dunn
*Assistant Examiner* — Timothy J Brindley
(74) *Attorney, Agent, or Firm* — Myers Bigel Sibley & Sajovec, P.A.

(57) ABSTRACT

A reclining seating unit includes: a frame; a backrest; a seat; main and auxiliary footrests; and a reclining linkage connected between the frame, backrest, seat, main footrest and auxiliary footrest. The reclining mechanism comprises a series of pivotally interconnected links and is configured to move the seating unit between an upright position, a TV position, and a fully reclined position. The reclining mechanism includes a footrest linkage that includes: an upper footrest extension link; a lower footrest extension link; a main footrest bracket on which the main footrest is mounted, the upper footrest extension link and the lower footrest extension link being pivotally connected to the main footrest bracket; a control link pivotally interconnected to the lower footrest extension link; a rear auxiliary footrest swing link pivotally attached to the main footrest bracket and to the control link; a front auxiliary footrest swing link pivotally attached to the main footrest bracket; and an auxiliary footrest bracket to which the auxiliary footrest is mounted, the rear and front auxiliary footrest swing links being pivotally attached to the auxiliary footrest bracket. This configuration can enable the footrest to extend a significant distance in front of the seat in the TV and fully reclined positions.

23 Claims, 11 Drawing Sheets

(56) References Cited

U.S. PATENT DOCUMENTS

| | | | | | |
|---|---|---|---|---|---|
| 3,102,753 | A | | 9/1963 | Schliephacke | |
| 3,140,117 | A | | 7/1964 | Fletcher | |
| 3,652,125 | A | | 3/1972 | Rogers, Jr. | |
| 3,836,197 | A | | 9/1974 | Goff et al. | |
| 3,844,607 | A | | 10/1974 | Ré | |
| 3,865,432 | A | * | 2/1975 | Rogers et al. | 297/316 |
| 3,871,704 | A | | 3/1975 | Shoemaker et al. | |
| 4,188,062 | A | | 2/1980 | Rogers, Jr. et al. | |
| 4,691,961 | A | | 9/1987 | Rogers, Jr. et al. | |
| 4,830,429 | A | | 5/1989 | Petitjean | |
| 5,044,692 | A | | 9/1991 | Tidwell, Jr. et al. | |
| 5,090,768 | A | * | 2/1992 | Re et al. | 297/85 L |
| 5,129,701 | A | * | 7/1992 | Pine | 297/68 |
| 5,169,208 | A | * | 12/1992 | Re et al. | 297/85 L |
| 5,310,243 | A | | 5/1994 | Pine | |
| 5,346,277 | A | | 9/1994 | Holobaugh et al. | |
| 5,354,116 | A | * | 10/1994 | May et al. | 297/85 L |
| 5,368,366 | A | * | 11/1994 | Mizelle | 297/423.3 |
| 5,374,100 | A | | 12/1994 | Rogers et al. | |
| 5,374,101 | A | * | 12/1994 | Wiecek | 297/85 R |
| 5,388,886 | A | * | 2/1995 | LaPointe et al. | 297/75 |
| 5,419,611 | A | * | 5/1995 | Cook | 297/85 L |
| 5,582,457 | A | * | 12/1996 | Komorowski et al. | 297/75 |
| 5,704,686 | A | * | 1/1998 | May | 297/281 |
| 5,772,278 | A | * | 6/1998 | Kowalski | 297/85 L |
| 5,845,961 | A | * | 12/1998 | LaPointe et al. | 297/75 |
| 6,192,565 | B1 | | 2/2001 | Tame | |
| 6,793,279 | B2 | * | 9/2004 | Hoffman et al. | 297/84 |
| 7,357,450 | B2 | * | 4/2008 | Rogers | 297/68 |
| 7,445,279 | B2 | * | 11/2008 | Crum | 297/84 |
| 7,641,277 | B2 | * | 1/2010 | Lawson et al. | 297/85 L |
| 7,669,921 | B2 | * | 3/2010 | Hoffman et al. | 297/61 |
| 7,762,625 | B2 | * | 7/2010 | Hoffman et al. | 297/85 L |
| 8,113,574 | B2 | * | 2/2012 | Hoffman et al. | 297/85 M |
| 2008/0012396 | A1 | * | 1/2008 | Hoffman et al. | 297/85 |
| 2012/0112517 | A1 | * | 5/2012 | Hoffman et al. | 297/85 L |
| 2012/0112518 | A1 | * | 5/2012 | Murphy et al. | 297/85 L |

* cited by examiner

RECLINING SEATING UNIT WITH EXTENDABLE FOOTREST

RELATED APPLICATIONS

The present invention claims priority from U.S. Provisional Patent Application No. 61/409,659, filed Nov. 1, 2010, and from U.S. Provisional Patent Application No. 61/479,104, filed Apr. 26, 2011, the disclosure of each of which is hereby incorporated herein in its entirety.

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability.

As chair styles vary, providing reclining capability can become a challenge, particularly for chairs with smaller frames, off-the floor styles, or low seat heights. In particular, footrest extension can become an issue for some chair styles, as the ability to extend a footrest forwardly can be limited by the amount of space available beneath the seat of the chair. Such space may be limited in off-the-floor styles if the reclining mechanisms are to remain hidden when the chair is in the upright position. Also, space may be limited for a chair with a low seat height or a relatively tall base, such as one having a swivel unit. As such, it may be desirable to provide footrest extension mechanisms that can extend a footrest an adequate distance while still functioning with multiple chair styles.

SUMMARY OF THE INVENTION

As a first aspect, embodiments of the invention are directed to a reclining seating unit. The reclining seating unit comprises: a frame; a backrest; a seat; main and auxiliary footrests; and a reclining linkage connected between the frame, backrest, seat, main footrest and auxiliary footrest. The reclining mechanism comprises a series of pivotally interconnected links and is configured to move the seating unit between an upright position, a TV position, and a fully reclined position. The reclining mechanism includes a footrest linkage that includes: an upper footrest extension link; a lower footrest extension link; a main footrest bracket on which the main footrest is mounted, the upper footrest extension link and the lower footrest extension link being pivotally connected to the main footrest bracket; a control link pivotally interconnected to the lower footrest extension link; a rear auxiliary footrest swing link pivotally attached to the main footrest bracket and to the control link; a front auxiliary footrest swing link pivotally attached to the main footrest bracket; and an auxiliary footrest bracket to which the auxiliary footrest is mounted, the rear and front auxiliary footrest swing links being pivotally attached to the auxiliary footrest bracket. This configuration can enable the footrest to extend a significant distance in front of the seat in the TV and fully reclined positions while still retracting into a small space in the upright position.

As a second aspect, embodiments of the present invention are directed to a reclining seating unit, comprising: a frame; a backrest; a seat; main and auxiliary footrests; and a reclining linkage connected between the frame, backrest, seat, main footrest and auxiliary footrest. The reclining mechanism comprises a series of pivotally interconnected links and is configured to move the seating unit between an upright position, a TV position, and a fully reclined position. The reclining mechanism includes a footrest linkage attached to the main footrest and to the auxiliary footrest. In the upright position, the auxiliary footrest is positioned rearwardly of the main footrest and is generally upright. In the TV position, the main and auxiliary footrests are generally horizontally disposed in front of the frame. In moving from the upright to the TV position, the auxiliary footrest moves downwardly relative to the frame no more than about 3 inches.

As a third aspect, embodiments of the present invention are directed to a reclining seating unit, comprising: a frame; a backrest; a seat; main and auxiliary footrests; and a reclining linkage connected between the frame, backrest, seat, main footrest and auxiliary footrest. The reclining mechanism comprises a series of pivotally interconnected links and is configured to move the seating unit between an upright position, a TV position, and a fully reclined position. The reclining mechanism includes a footrest linkage that includes: a main footrest bracket on which the main footrest is mounted; a rear auxiliary footrest swing link pivotally attached to the main footrest bracket; a front auxiliary footrest swing link pivotally attached to the main footrest bracket; and an auxiliary footrest bracket to which the auxiliary footrest is mounted, the rear and front auxiliary footrest swing links being pivotally attached to the auxiliary footrest bracket. In the upright position, the auxiliary footrest is positioned rearwardly of the main footrest, and a portion of the rear auxiliary footrest swing link is positioned laterally of the auxiliary footrest.

DETAILED DESCRIPTION OF EMBODIMENTS OF THE INVENTION

Figure 1:
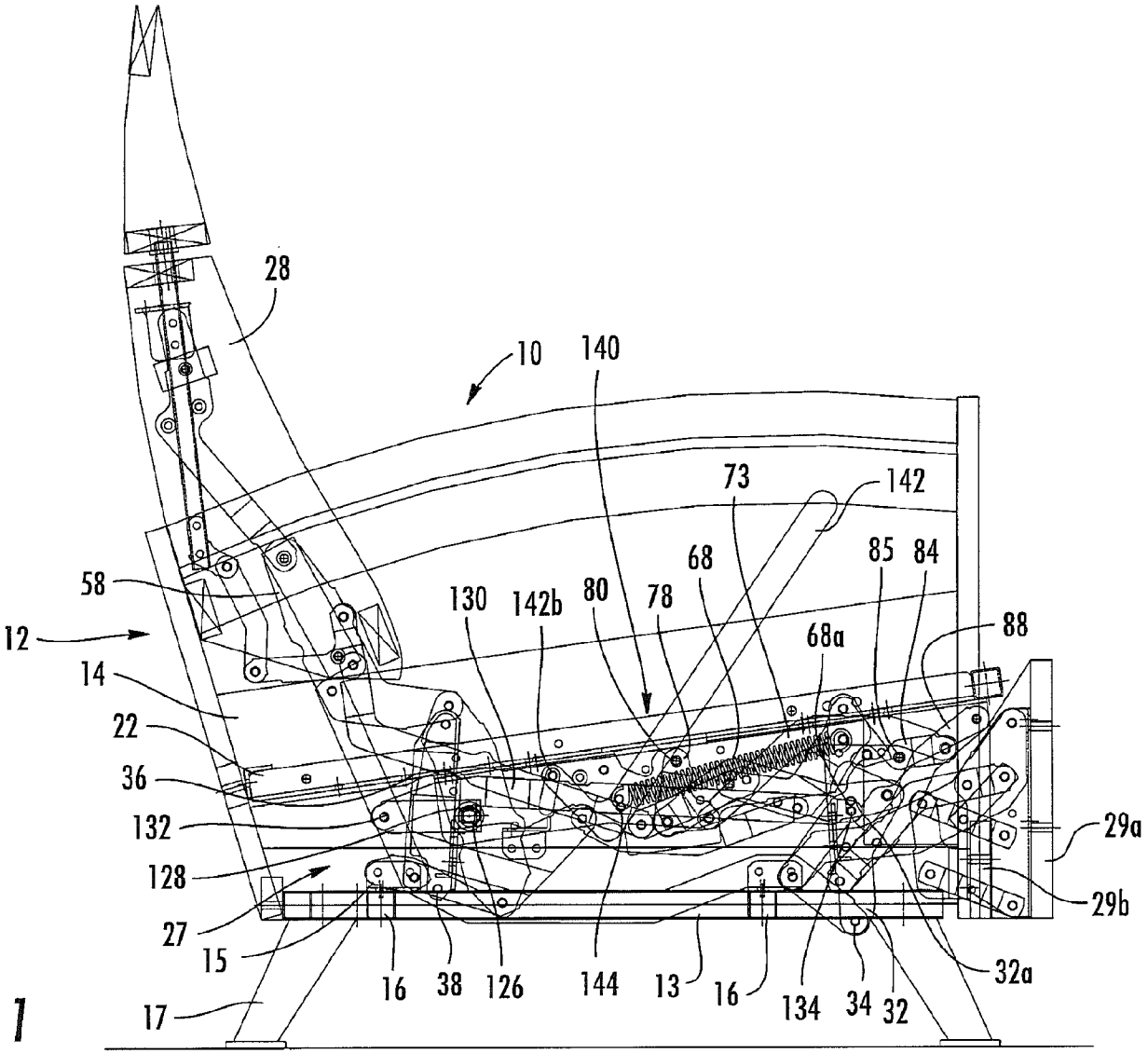
FIG. 1 is a cutaway side view of a reclining chair according to embodiments of the present invention, with the chair in its upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the drawings, a chair, designated broadly at 10, is illustrated in FIGS. 1-5. The chair 10 includes a frame 12, a seat 22, a backrest 28, and footrests 29*a*, 29*b*. These components identified above are described in greater detail below. As used herein to describe the relative positions of components, the terms "lateral", "outward" and derivatives thereof indicate the directions defined by a vector beginning at a vertical plane that bisects the chair 10 normal to the seat 22 and the backrest 28 and extending normal thereto. Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Referring to FIG. 1, the frame 12 includes opposed arms 14 to which mounting panels 15 are mounted. Feet 17 are mounted to side rails 13. Cross-members 16 span the mounting panels 15 on either side of the chair 10 and are mounted to the cross-members 16.

Referring again to FIGS. 1-4, the frame 12, seat 22, backrest 28 and footrests 29*a*, 29*b* are interconnected by a pair of reclining mechanisms 27, which mount the seat 22, backrest 28 and footrest unit 29 to the frame 12. The reclining mechanisms 27 move the backrest 28, seat 22 and footrests 29*a*, 29*b* between (a) an upright position (FIG. 1), in which the backrest 28 is generally upright and positioned above the rear portion of the seat 22, the seat 22 is generally positioned between the arms 14, and the footrests 29*a*, 29*b* are generally vertically disposed in front of the frame 14, (b) a TV position (FIG. 3), in which the footrests unit 29*a*, 29*b* are extended forwardly of the seat 22 and the backrest 28 substantially maintains its angular relationship to the underlying surface, and (c) a fully reclined position (FIG. 4), in which the footrests 29*a*, 29*b* remained extended and the backrest 28 is reclined relative to the upright position. The reclining mechanisms 27 are mirror images of one another about the aforementioned bisecting plane; as such, only one reclining mechanism 27 is described herein, with the understanding that this discussion is equally applicable to the reclining mechanism on the opposite side of the chair 10. Also, for clarity the reclining mechanism 27 will be described first with respect to FIG. 4, wherein the chair 10 is in the fully reclined position; its movement to the upright and TV positions (FIGS. 1 and 3) will then follow.

Figure 4:
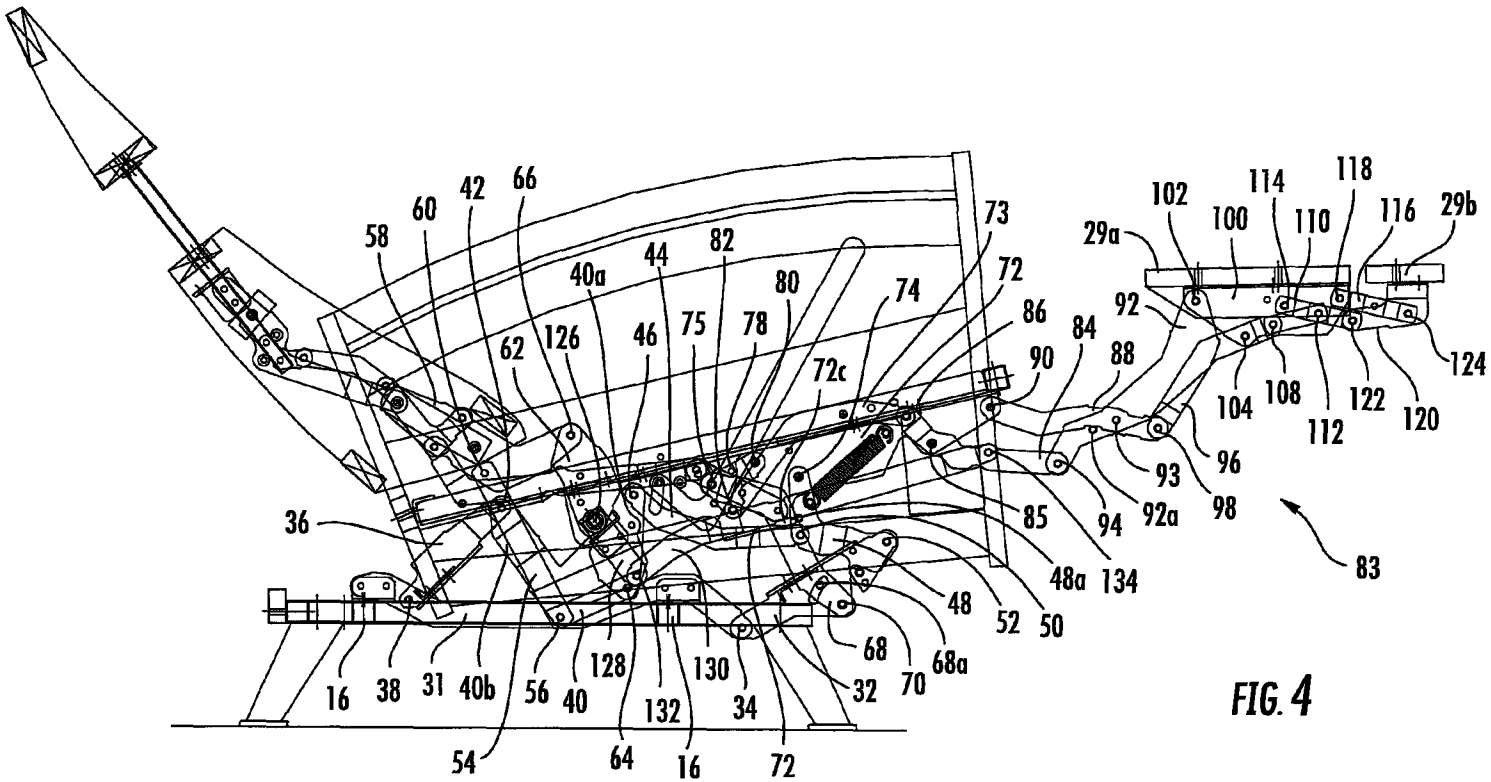
FIG. 4 is a cutaway side view of the reclining chair of FIG. 1 with the chair in its fully reclined position.

Referring now to FIG. 4, the reclining mechanism 27 includes a foundation link 31 that is mounted to the cross-members 16 of the frame 12. A front swing link 32 is attached to the front end of the foundation link 31 at a pivot 34 and extends upwardly and forwardly therefrom. A rear swing link 36 is attached to the rear end of the foundation link 31 at a pivot 38 and also extends upwardly and forwardly therefrom. A generally C-shaped transition plate 40 has front and rear fingers 40*a*, 40*b*; the rear finger 40*b* is attached to the upper end of the rear swing link 36 at a pivot 42. A connecting link 44 is attached to the front finger 40*a* of the transition plate 40 at a pivot 46 and extends generally forwardly therefrom. A tripartite lifting link 48 is attached at an intermediate point to the forward end of the connecting link 44 at a pivot 50; a lower portion of the lifting link 48 is attached to the upper end of the front swing link 32 at a pivot 52.

The backrest 28 is mounted on a backpost 58. A rear reclining link 54 is attached to the backpost 58 at a pivot 60. The rear reclining link 54 extends forwardly and downwardly from the pivot 60 to a pivot 56 with the transition plate 40. The forward end of the backpost 58 is attached to a front reclining link 62 at a pivot 66. The lower end of the front reclining link 62 is attached to the transition plate 40 at a pivot 64.

A seat mounting bracket 72 is mounted to the underside of the seat 22. The upper end of the lifting link 48 is attached to the seat mounting bracket 72 at a pivot 74, and the front reclining link 62 is fixed to the seat mounting bracket 72. An L-shaped control link 78 is attached to the seat mounting bracket 72 at a pivot 80. A bracing link 68 extends between a pivot 75 with the control link 78 and a pivot 70 with the front swing link 32. The bracing link 68 includes a sequencing pin 68*a* that is received in a slot 32*a* in the front swing link 32. The control link 78 is attached to a footrest drawing link 73 at a pivot 82.

A drive link 128 is attached to a cross-member 126 that extends between the drive links 128 on either side of the chair 10. The cross-member 126 is rotatably mounted to the front reclining links 62 through the seat mounting brackets 72 and spans the width of the chair 10. A footrest drive link 130 is attached to the lower end of the drive link 128 at a pivot 132. The footrest drive link 130 extends forwardly to attach to a footrest linkage 83.

The footrest linkage 83 includes a lower footrest swing link 84 that is attached to the seat mounting bracket 72 at a pivot 85 and extends forwardly therefrom. The lower footrest swing link 84 is also attached to the footrest drawing link 73 at a pivot 86 and to the footrest drive link 130 at a pivot 134. An upper footrest swing link 88 is also attached to the seat mounting bracket 72 at a pivot 90 and extends forwardly therefrom. An upper footrest extension link 92 is attached to the forward end of the lower footrest swing link 84 at a pivot 94 and extends upwardly and forwardly therefrom. The upper footrest extension link 92 is also attached to the upper footrest swing link 88 at a pivot 93. A lower footrest extension link 96 is attached to the forward end of the upper footrest swing link 88 at a pivot 98 and extends forwardly and upwardly therefrom. A main footrest bracket 100 is attached to the forward ends of the upper footrest extension link 92 and the lower footrest extension link 96 at, respectively, pivots 102, 104. The main footrest 29*a* is mounted on the main footrest bracket 100. A rear auxiliary footrest swing link 110 is attached to the main footrest bracket 100 at a pivot 114, and a front auxiliary footrest swing link 116 of approximately the same length as the rear auxiliary footrest swing link 110 is attached to the main footrest bracket 100 at a pivot 118. An auxiliary footrest bracket 120 is attached to the front ends of the swing links 110, 116 at, respectively, pivots 122, 124. A control link 106 is attached to the forward end of the lower footrest extension link 96 at a pivot 108 and to the rear auxiliary footrest swing link 110 at a pivot 112. The auxiliary footrest 29*b* is mounted on the auxiliary footrest bracket 120.

Figure 5:
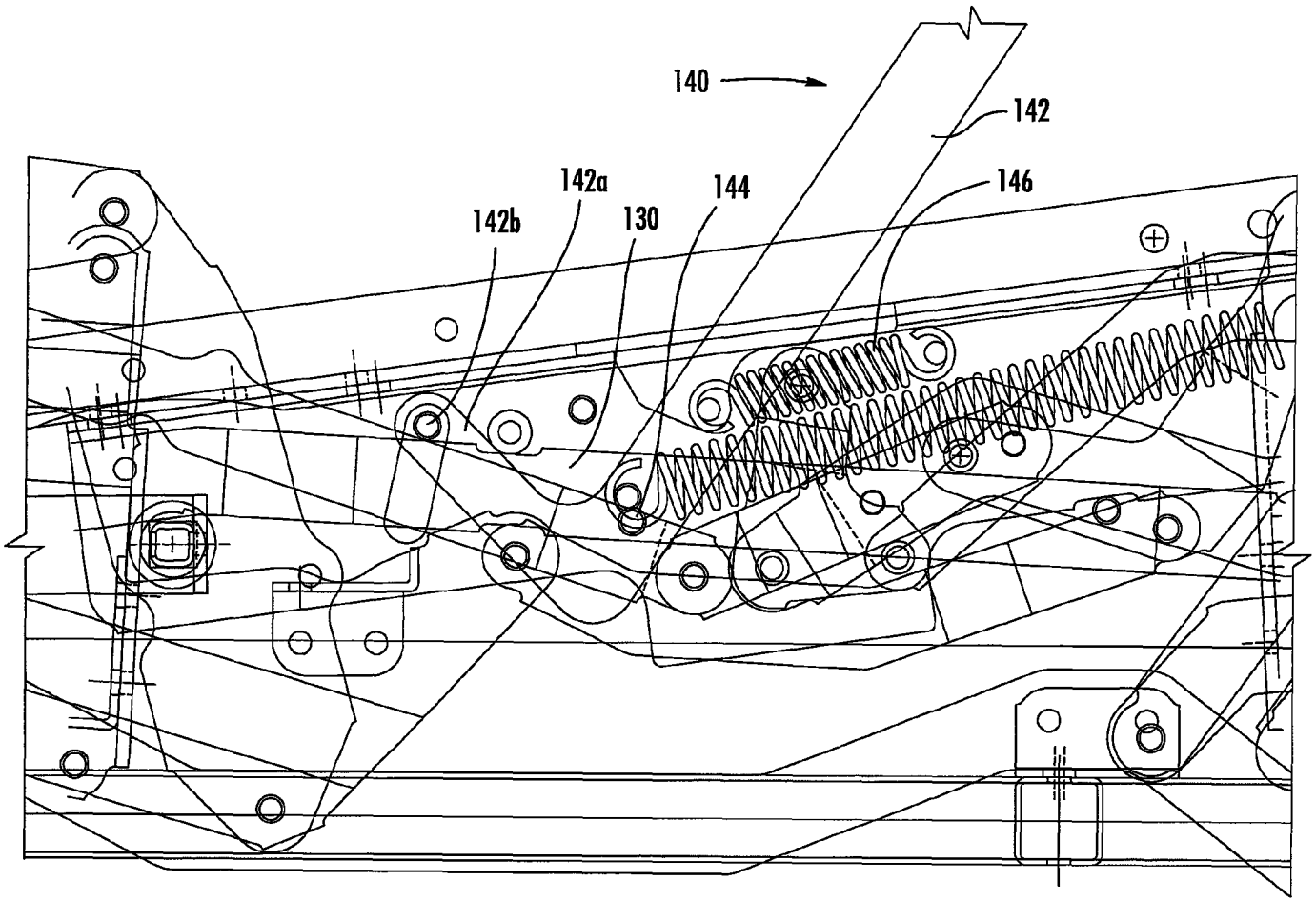
FIG. 5 is an enlarged side view of the actuation mechanism of the reclining chair of FIG. 1.

Referring now to FIG. 5, an actuating mechanism 140 includes a handle 142 attached to the seat mounting bracket 72 at a pivot 144. A rear extension 142*a* of the handle 142 includes a pin 142*b* that is received in a slot 72*a* in the seat mounting bracket 72. A spring 146 extends between the ottoman drive link 130 and the seat mounting bracket 72.

The chair 10 typically begins in the upright position shown in FIG. 1. In the upright position, the footrest linkage 83 is folded underneath the front end of the seat 22. The backpost 58 (and in turn the backrest 28) are relatively upright. The front and rear swing links 32, 36 are generally vertically disposed, such that the seat 22 is positioned above the base 12 with a slight pitch (about 5 to 10 degrees relative to horizontal). The main footrest 29*a* is vertically disposed just in front of the seat 22, and the auxiliary footrest 29*b* is vertically disposed just rearward of the main footrest 29*a*. The rear and front auxiliary footrest swing links 110, 114 are oriented such that a portion of each is positioned laterally of the auxiliary footrest 29*b*. The reclining mechanism 27 is maintained in the upright position by virtue of an "over-center" arrangement of the pivots 132, 126, 134.

Figure 2:
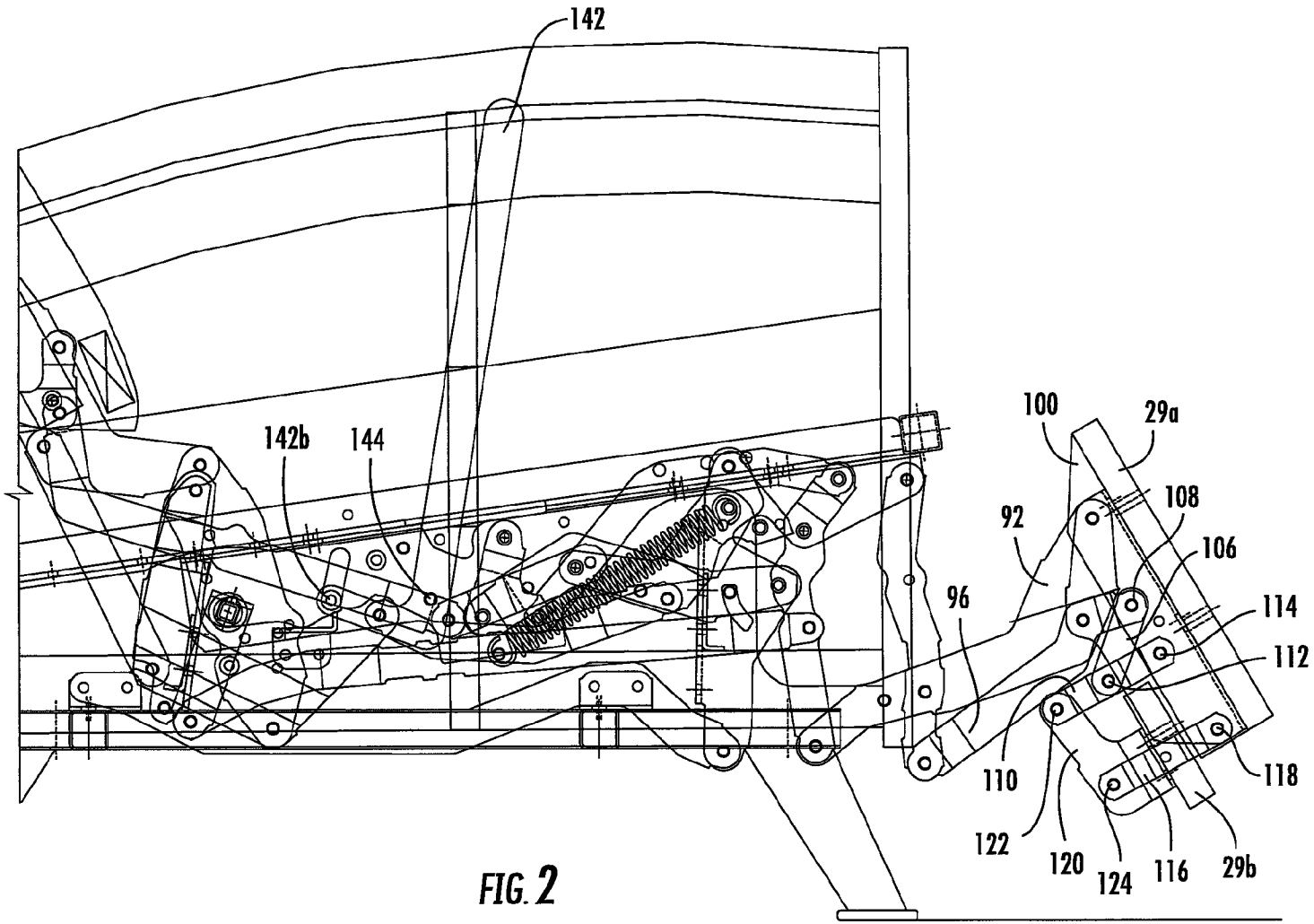
FIG. 2 is an enlarged cutaway side view of the reclining chair of FIG. 1 with the chair between its upright and TV positions.
Figure 3:
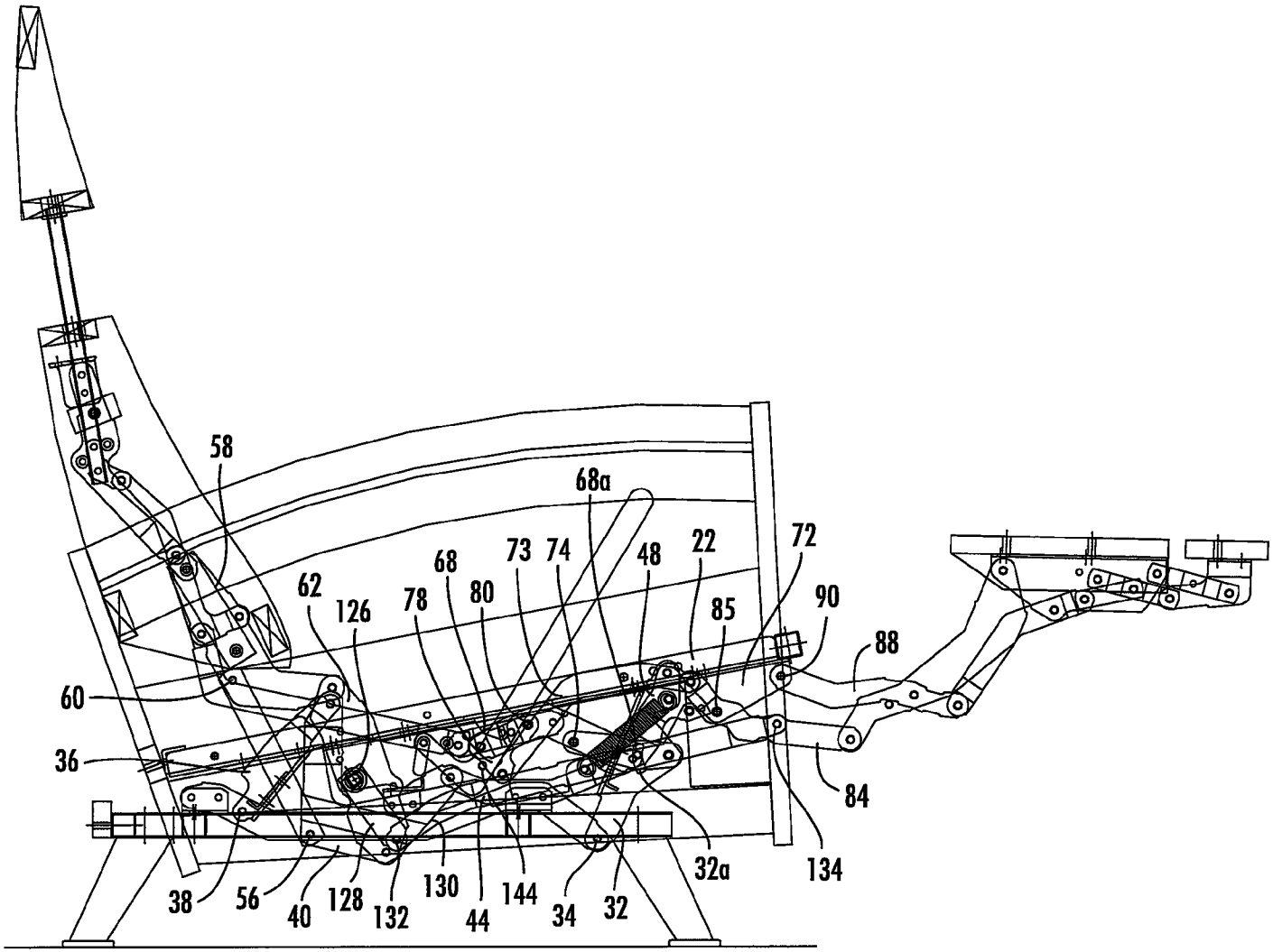
FIG. 3 is a cutaway side view of the reclining chair of FIG. 1 with the chair in its TV position.

To move the chair 10 to the TV position of FIG. 3, the occupant of the chair 10 pulls the handle 142 of the actuating mechanism 140 rearwardly, causing it to pivot counterclockwise about the pivot 144. (Movement of the handle 142 is shown in FIG. 2). Rotation of the handle 142 forces the pin 142*b* into the upper edge of the footrest drive link 130, thereby pushing it downwardly. Once the downward movement of the footrest drive link 130 has drawn the pivot 132 past its "over-center" condition with the pivots 126, 134, the footrest drive link 130 continues downwardly and forwardly as the drive link 128 rotates counterclockwise about the pivot 126. This movement is augmented by the weight of the occupant. After the occupant releases the handle 142, the handle 142 returns to its original position due to tension in the spring 146.

The weight of the occupant also causes the rear swing link 36 to rotate clockwise about the pivot 38 and the front swing link 32 to rotate clockwise about the pivot 34. The rotation of these two links 32, 36 causes the seat 22 to descend and move forwardly relative to the base 12. Movement of the front swing link 32 also draws the bracing link 68 forward, with the pin 68*a* moving from the upper end of the slot 32*a* to the center.

Figure 1A:
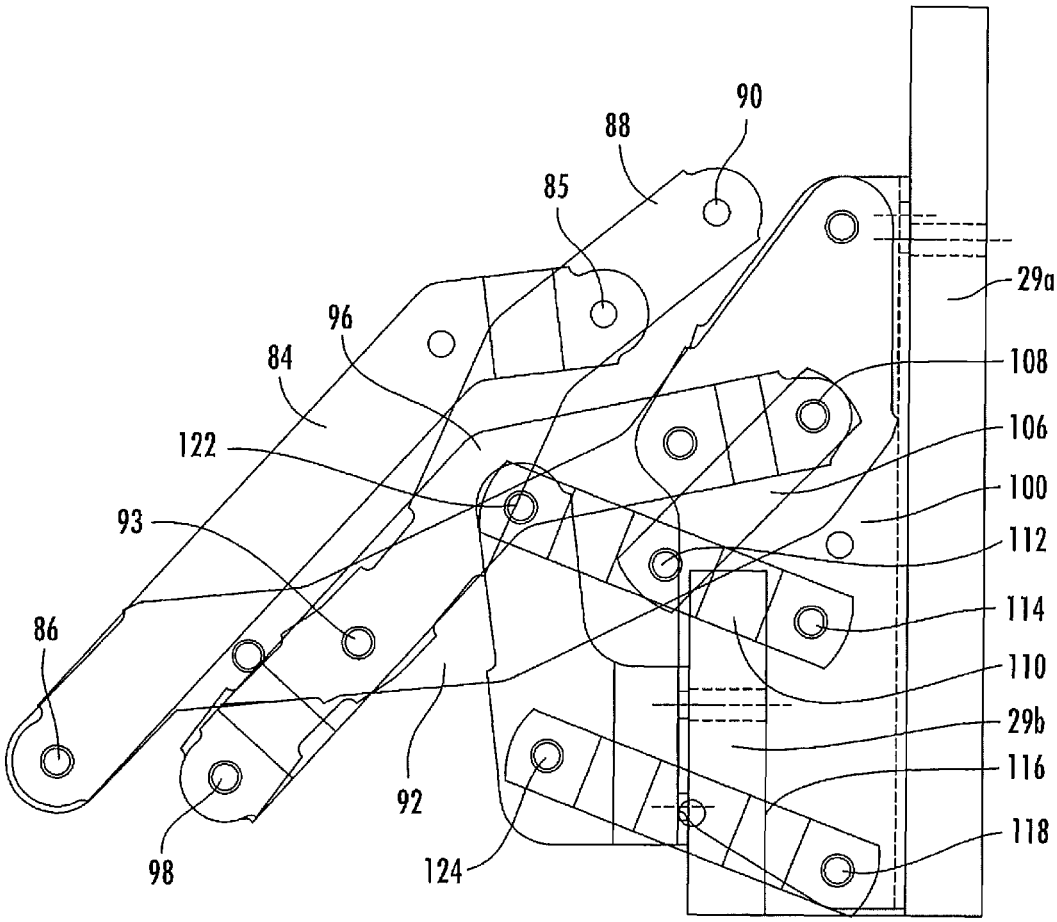
FIG. 1A is a side view of the footrest linkage of the chair of FIG. 1 shown in its upright position.
Figure 3A:
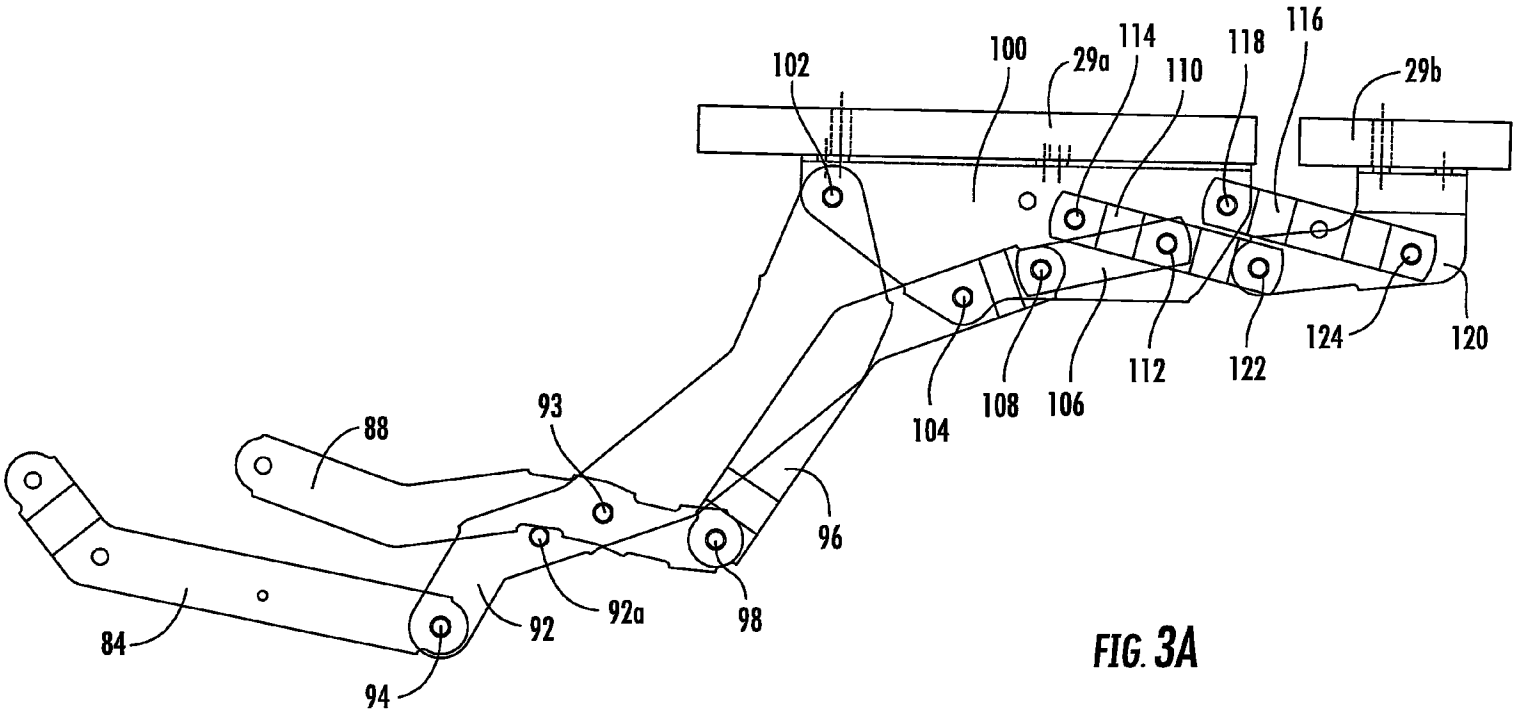
FIG. 3A is a side view of the footrest linkage of FIG. 1 shown in its TV position.

The forward movement of the footrest drive link 130 forces the lower footrest swing link 84 to rotate counterclockwise about the pivot 85 (FIG. 1A). The pivotal movement of the lower footrest swing link 84 drives the upper footrest extension link 92 forwardly and upwardly, which in turn draws the upper footrest swing link 88 counterclockwise about the pivot 90. Movement of the upper footrest swing link 88 drives the lower footrest extension link 96 forwardly and upwardly. In addition, the lower footrest extension link 96 moves forward relative to the upper footrest extension link 88, with the result that the main footrest bracket 100 and the main footrest 29*a* rotate to a generally horizontal disposition (FIG. 3A).

The rotation of the lower ottoman extension link 96 relative to the main ottoman bracket 100 also forces the control link 106 forward. The movement of the control link 106 drives the rear auxiliary footrest swing link 110 counterclockwise about the pivot 114. This movement forces the auxiliary footrest bracket 120 and the auxiliary footrest 29*b* forward, with its movement controlled by the front auxiliary footrest swing link 116.

As can be seen in FIG. 2, the control link 106 experiences little movement relative to the main footrest bracket 100 until the front lower edge of the main footrest 29*a* has extended forwardly somewhat (typically between about 4 to 8 inches) and the main footrest 29*a* has rotated about 20-40 degrees relative to vertical. During this movement, the auxiliary footrest 29*b* descends only about 3 inches, and in some embodiments only about 2 inches, from its starting height. This enables the auxiliary footrest 29*b* to avoid contacting a tall base, such as that having a swivel unit. Only when past the point shown in FIG. 2 does the control link 106 begin to significantly drive the rear auxiliary footrest swing link 110 counterclockwise about the pivot 114. Because the extension of the auxiliary footrest 29*b* away from the main footrest 29*a* is delayed somewhat, the footrest linkage 83 can be deployed with chairs, such as chairs with swiveling bases and/or low seat heights, that have relatively little clearance between the lower edge of the seat frame and the underlying surface.

The movement of the footrest unit 29 ceases when the lower edge of the upper footrest swing link 88 strikes a pin 92*a* on the upper footrest extension link 92.

The forward movement of the footrest drive link 130 also draws the upper end of the lower footrest swing link 84 rearward relative to the seat mounting bracket 72. This action forces the footrest drawing link 73 rearward relative to the seat mounting bracket 72 and rotates the control link 78 clockwise about the pivot 80. The motion of the control link 78 (which is also impacted by the forward movement of the bracing link 68 discussed above) causes the seat 22 to take a greater pitch angle relative to horizontal than it has in the upright position.

To move the chair 10 from the TV position of FIG. 3 to the fully reclined position of FIG. 4, the occupant presses against the backrest 28 (often by pushing forward on the arms of the chair). Such a force pivots the backpost 58 counterclockwise about the pivot 60. Rotation of the backpost 58 draws the rear reclining link 54 forwardly and slightly upwardly, which in turn causes the transition plate 40 to rotate counterclockwise about the pivot 56. Movement of the transition plate 40 raises the rear end of the connecting link 44, which draws the lifting link 48 clockwise about the pivot 74. This action drives the upper end of the front swing link 32 forwardly, thereby rotating it about the pivot 34. Rotation of the front swing link 32 lowers the front end of the bracing link 68. The rising of the front reclining link 62 and the rotation of the lifting link 48 force the seat mounting bracket 72 and the seat 22 upwardly (at a slightly higher pitch angle than in the TV position). The reclining movement ceases when a pin 48*a* on the lifting link 48 strikes a protrusion 72*c* in the seat mounting bracket 72.

The chair 10 can be moved from the fully reclined position to the TV and upright positions by first pulling forward on the arms, then pressing downward on the main footrest 29*a* and the auxiliary footrest 29*b*. The links reverse the motion described above and revert first to the TV position, then to the upright position.

Referring now to FIGS. 6-9, an alternative embodiment of a reclining chair, designated broadly at 200, is illustrated therein. The chair 200 includes a reclining mechanism 210 that is identical to that of the chair 10; however, the chair 200 includes a power actuator to move the chair 200 between upright, TV and fully reclined positions. Thus, the chair 200 lacks the actuating mechanism 140 of the chair 10, and also lacks links 122, 126 and 130. These components are replaced with an actuating mechanism 240, which is described in detail below.

Figure 9:
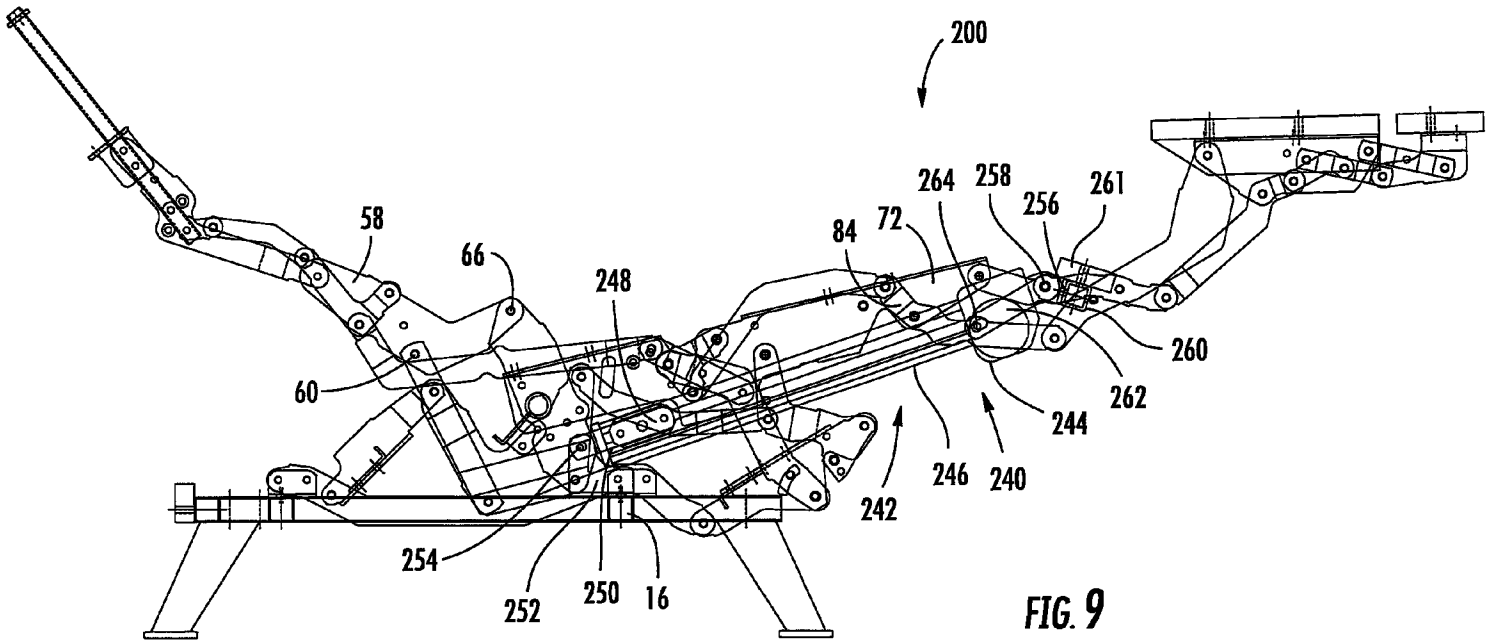
FIG. 9 is a side view of the reclining mechanism of the chair of FIG. 6 in its fully reclined position.

Referring to FIG. 9 (which illustrates the chair 200 in its fully reclined position), the actuating mechanism 240 includes an actuator 242 that has a motor 244, a rod 246 attached to the motor 244, and guides 248 that receive the rod 246. The guides 248 are fixed to two rocker links 250 (only one of which is shown herein) that extend rearwardly therefrom. Each of the rocker links 250 is attached to respective foundation member 252 at a pivot 254. The foundation links 252 are fixed to the cross-member 16.

The motor 244 is positioned at the forward end of the actuator 242. A bracket 256 is attached to the motor 244 at a pivot 258. The bracket 256 is also fixed to a cross-member 260 than spans much of the width of the chair 200. A footrest drive link 262 is mounted to the cross-member 260 at each end thereof and, in the fully reclined position, extends rearwardly therefrom to a pivot 264 (in this embodiment, in the form of a pin and slot) with the lower footrest swing link 84. The footrest drive link 262 is also attached to the upper footrest swing link 88 at a pivot (not clearly seen in FIG. 9) that is substantially coaxial with the pivot 258. Also, a guard 261 is fixed to the upper surface of the cross-member 260.

Figure 6:
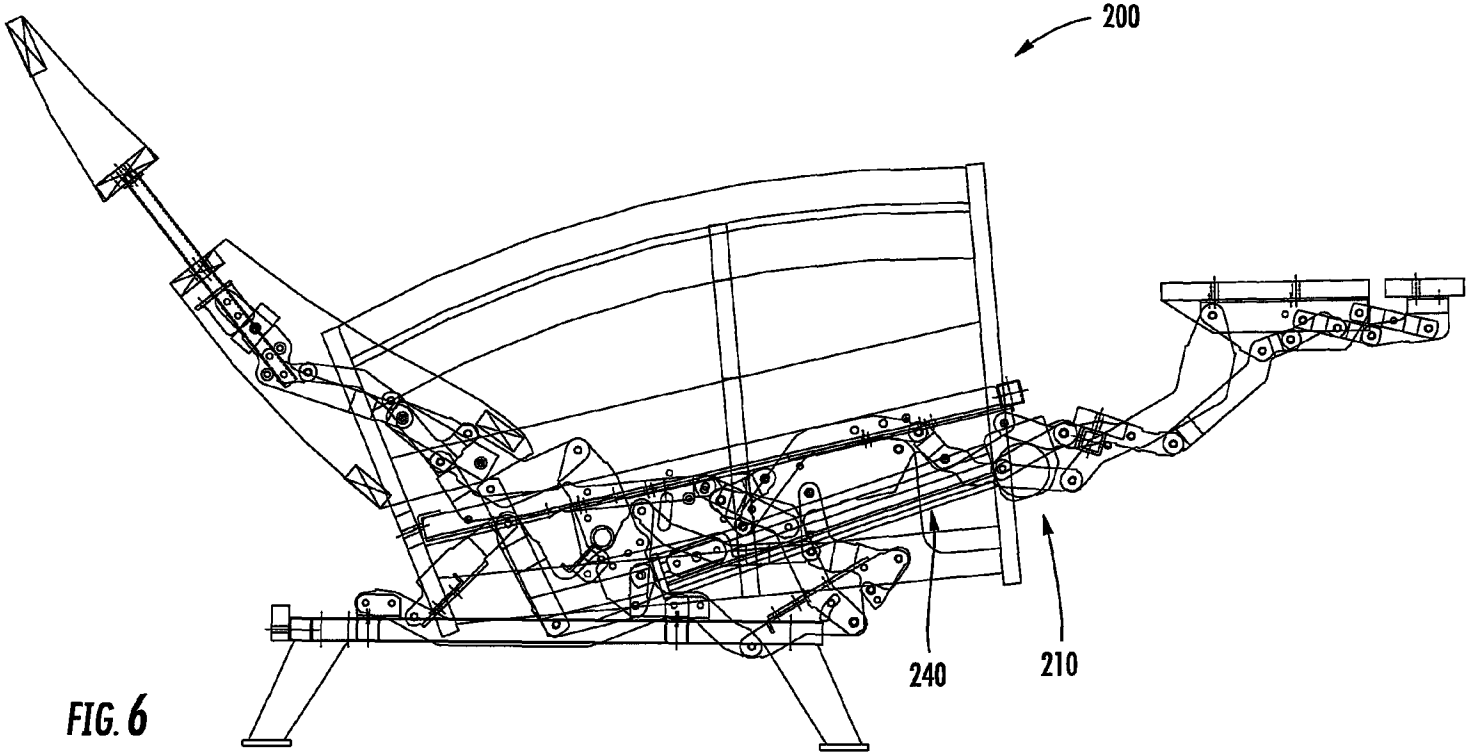
FIG. 6 is a cutaway side view of a reclining chair according to additional embodiments of the present invention, with the chair in its fully reclined position.
Figure 7:
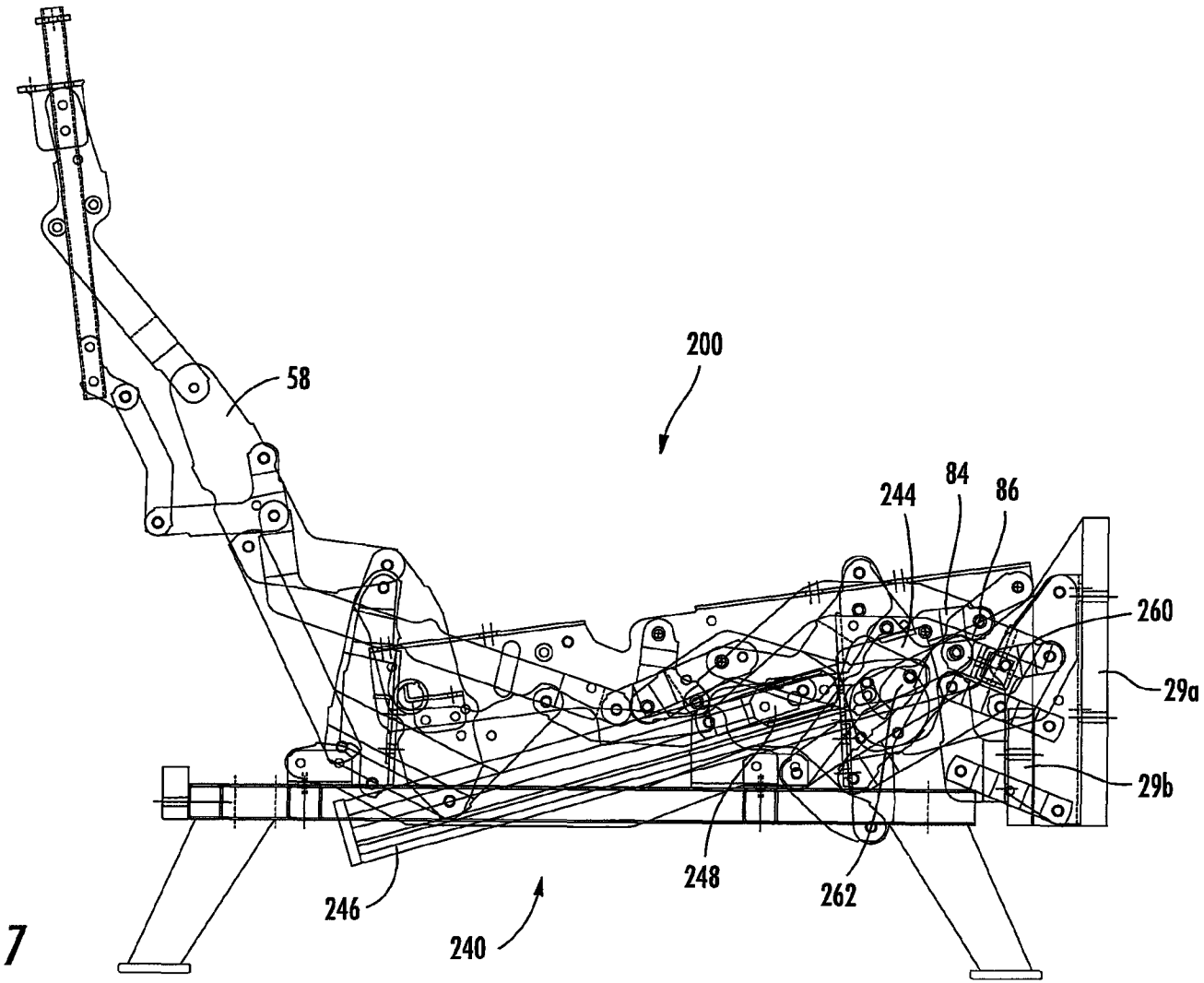
FIG. 7 is a side view of the reclining mechanism of the chair of FIG. 6 in its upright position.
Figure 8:
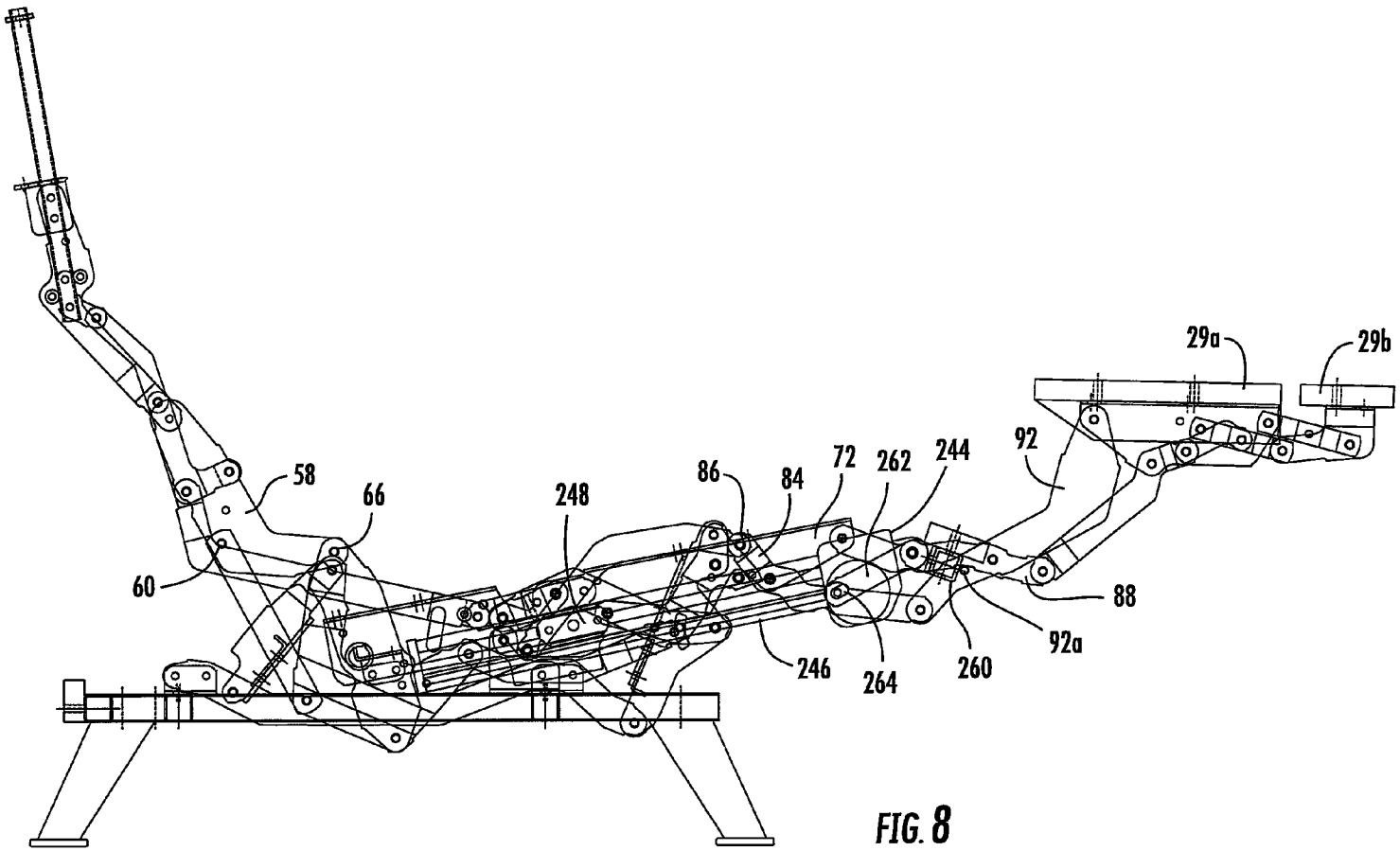
FIG. 8 is a side view of the reclining mechanism of the chair of FIG. 6 in its TV position.

Referring now to FIGS. 6 and 7, when the chair 200 is in its upright position, the actuator 242 is disposed such that the motor 244 is located just forwardly of the guides 248. As with the chair 10, in the upright position the lower footrest swing link 84 extends downwardly and rearwardly from the pivot 86, and the remainder of the footrest linkage is retracted. The footrest drive link 262 extends rearwardly from the cross-member 260. When an occupant of the chair 10 energizes the motor 242 of the actuator 240, the rod 246 slides forwardly relative to the guides 248 and moves the motor 244 forward. Forward movement of the motor 244 draws the footrest drive link 262 forward also. This action forces the lower footrest swing link 84 to rotate counterclockwise about the pivot 85. As described above, this movement of the lower footrest swing link 84 extends the main footrest 29*a* and the auxiliary footrest 29*b* into the TV position (FIG. 8).

Once the footrests 29*a*, 29*b* are extended into the TV position, and the lower edge of the upper footrest swing link 88 strikes the pin 92*a* on the upper footrest extension link 92, energizing the motor 242 further causes the rod 246 to continue to slide relative to the guides 248. Because the lower footrest swing link 84 cannot extend any further, additional forwardly-directed force on the lower footrest swing link 84 forces the seat mounting bracket 72 forwardly. This movement draws the pivot 66 forward, which rotates the backpost 58 counterclockwise about the pivot 60. The remaining movements of the links that control movement between the TV and fully reclined positions are as described above in connection with the chair 10 and result in the chair 200 moving to the fully reclined position (FIG. 9).

Those of skill in this art will appreciate that the chair 200 can enjoy many of the benefits and performance advantages that are achievable with the chair 10, but with the convenience of power-actuated movement between positions.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reclining seating unit, comprising:

a frame;

a backrest;

a seat;

main and auxiliary footrests;

a reclining linkage connected between the frame, backrest, seat, main footrest and auxiliary footrest, the reclining mechanism comprising a series of pivotally interconnected links and configured to move the seating unit between an upright position, a TV position, and a fully reclined position;

wherein the reclining mechanism includes a footrest linkage, the footrest linkage including:

an upper footrest extension link;

a lower footrest extension link;

a main footrest bracket on which the main footrest is mounted, the upper footrest extension link and the lower footrest extension link being pivotally connected to the main footrest bracket;

a control link pivotally interconnected to the lower footrest extension link;

a rear auxiliary footrest swing link pivotally attached to the main footrest bracket and to the control link;

a front auxiliary footrest swing link pivotally attached to the main footrest bracket; and an auxiliary footrest bracket to which the auxiliary footrest is mounted, the rear and front auxiliary footrest swing links being pivotally attached to the auxiliary footrest bracket.

2. The seating unit defined in claim 1, wherein the rear auxiliary footrest link and the front auxiliary footrest link are substantially the same length.

3. The seating unit defined in claim 1, wherein in the upright position, the auxiliary footrest is positioned rearwardly of the main footrest.

4. The seating unit defined in claim 3, wherein in the upright position, the auxiliary footrest is generally vertically disposed.

5. The seating unit defined in claim 4, wherein in the TV position, the main and auxiliary footrests are generally horizontally disposed in front of the frame, and wherein, in moving from the upright to the TV position, the auxiliary footrest moves downwardly relative to the frame no more than about 3 inches.

6. The seating unit defined in claim 5, wherein when the auxiliary footrest is at its lowest point, a lower front edge of the main footrest is about 4 to 8 inches from a forwardmost portion of the seat.

7. The seating unit defined in claim 1, further comprising a power actuator.

8. The seating unit defined in claim 1, wherein in the upright position, a portion of the rear auxiliary footrest swing link and a portion of the front auxiliary footrest link are positioned laterally of the auxiliary footrest.

9. A reclining seating unit, comprising:

a frame;

a backrest;

a seat;

main and auxiliary footrests;

a reclining linkage connected between the frame, backrest, seat, main footrest and auxiliary footrest, the reclining mechanism comprising a series of pivotally interconnected links and configured to move the seating unit between an upright position, a TV position, and a fully reclined position;

wherein the reclining mechanism includes a footrest linkage attached to the main footrest and to the auxiliary footrest; and wherein in the upright position, the auxiliary footrest is positioned rearwardly of the main footrest and is generally upright; and wherein in the TV position, the main and auxiliary footrests are generally horizontally disposed in front of the frame, and wherein, in moving from the upright to the TV position, the auxiliary footrest moves downwardly relative to the frame no more than about 3 inches.

10. The seating unit defined in claim 9, wherein when the auxiliary footrest is at its lowest point, a lower front edge of the main footrest is about 4 to 8 inches from a forwardmost portion of the seat.

11. The seating unit defined in claim 9, wherein when the auxiliary footrest is at its lowest point, the main footrest is disposed at an angle of between about 20 and 40 degrees relative to vertical.

12. The seating unit defined in claim 9, further comprising a power actuator.

13. The seating unit defined in claim 9, wherein the footrest linkage comprises a front auxiliary footrest swing link and a rear auxiliary footrest swing link pivotally interconnected with a main footrest bracket on which the main footrest is mounted, the front auxiliary footrest swing link and the rear auxiliary footrest swing link also pivotally attached to an auxiliary footrest bracket on which the auxiliary footrest is mounted.

14. The seating unit defined in claim 13, wherein in the upright position, a portion of the rear auxiliary footrest swing link and a portion of the front auxiliary footrest link are positioned laterally of the auxiliary footrest.

15. A reclining seating unit, comprising:

a frame;

a backrest;

a seat;

main and auxiliary footrests;

a reclining mechanism connected between the frame, backrest, seat, main footrest and auxiliary footrest, the reclining mechanism comprising a series of pivotally interconnected links and configured to move the seating unit between an upright position, a TV position, and a fully reclined position;

wherein the reclining mechanism includes a footrest linkage, the footrest linkage including:

a main footrest bracket on which the main footrest is mounted;

a rear auxiliary footrest swing link pivotally attached to the main footrest bracket;

a front auxiliary footrest swing link pivotally attached to the main footrest bracket; and an auxiliary footrest bracket to which the auxiliary footrest is mounted, the rear and front auxiliary footrest swing links being directly pivotally attached to the auxiliary footrest bracket;

wherein in the upright position, the auxiliary footrest is positioned rearwardly of the main footrest, and wherein a portion of the front auxiliary footrest link is positioned laterally of the auxiliary footrest; and wherein, in the TV position, the main and auxiliary footrests are generally horizontally disposed in front of the frame, with the auxiliary footrest being positioned forwardly of the main footrest.

16. The seating unit defined in claim 15, wherein in the upright position, the auxiliary footrest is generally vertically disposed.

17. The seating unit defined in claim 15, wherein a portion of the rear auxiliary footrest swing link is positioned laterally of the auxiliary footrest.

18. The seating unit defined in claim 15, wherein, in moving from the upright to the TV position, the auxiliary footrest moves downwardly relative to the frame no more than about 3 inches.

19. The seating unit defined in claim 18, wherein when the auxiliary footrest is at its lowest point, a lower front edge of the main footrest is about 4 to 8 inches from a forwardmost portion of the seat.

20. The seating unit defined in claim 18, wherein when the auxiliary footrest is at its lowest point, the main footrest is disposed at an angle of between about 20 and 40 degrees relative to vertical.

21. The seating unit defined in claim 15, further comprising a power actuator.

22. A reclining seating unit, comprising:

a frame;

a backrest;

a seat;

main and auxiliary footrests;

a reclining mechanism connected between the frame, backrest, seat, main footrest and auxiliary footrest, the reclining mechanism comprising a series of pivotally interconnected links and configured to move the seating unit between an upright position, a TV position, and a fully reclined position;

wherein the reclining mechanism includes a footrest linkage, the footrest linkage including:

a main footrest bracket on which the main footrest is mounted;

a rear auxiliary footrest swing link directly pivotally attached to the main footrest bracket;

a front auxiliary footrest swing link pivotally attached to the main footrest bracket; and an auxiliary footrest bracket to which the auxiliary footrest is mounted, the rear and front auxiliary footrest swing links being pivotally attached to the auxiliary footrest bracket, the rear auxiliary swing link being directly pivotally attached to the auxiliary footrest bracket;

wherein in the upright position, the auxiliary footrest is positioned rearwardly of the main footrest, and wherein a portion of the front auxiliary footrest link is positioned laterally of the auxiliary footrest; and wherein, in the TV position, the main and auxiliary footrests are generally horizontally disposed in front of the frame, with the auxiliary footrest being positioned forwardly of the main footrest.

23. A reclining seating unit, comprising:

a frame;

a backrest;

a seat;

main and auxiliary footrests;

a reclining mechanism connected between the frame, backrest, seat, main footrest and auxiliary footrest, the reclining mechanism comprising a series of pivotally interconnected links and configured to move the seating unit between an upright position, a TV position, and a fully reclined position;

wherein the reclining mechanism includes a footrest linkage, the footrest linkage including:

a main footrest bracket on which the main footrest is mounted;

a rear auxiliary footrest swing link pivotally attached to the main footrest bracket;

a front auxiliary footrest swing link directly pivotally attached to the main footrest bracket; and an auxiliary footrest bracket to which the auxiliary footrest is mounted, the rear and front auxiliary footrest swing links being pivotally attached to the auxiliary footrest bracket, the front auxiliary swing link being directly pivotally attached to the auxiliary footrest bracket;

wherein in the upright position, the auxiliary footrest is positioned rearwardly of the main footrest, and wherein a portion of the front auxiliary footrest link is positioned laterally of the auxiliary footrest; and wherein, in the TV position, the main and auxiliary footrests are generally horizontally disposed in front of the frame, with the auxiliary footrest being positioned forwardly of the main footrest.

* * * * *

UNITED STATES PATENT AND TRADEMARK OFFICE

CERTIFICATE OF CORRECTION

PATENT NO. : 8,752,890 B2
APPLICATION NO. : 13/157528
DATED : June 17, 2014
INVENTOR(S) : Murphy et al.

It is certified that error appears in the above-identified patent and that said Letters Patent is hereby corrected as shown below:

On Title Page, Line 2:
Item (60), Related U.S. Application Data:
Correct "No. 61/409,659, filed on November 1, 2010,"
to read -- No. 61/409,659, filed on November 3, 2010, --

In the Specification:
RELATED APPLICATIONS, Column 1, Line 7:
Correct "No. 61/409,659, filed on November 1, 2010,"
to read -- No. 61/409,659, filed on November 3, 2010, --

Signed and Sealed this
Ninth Day of December, 2014

Michelle K. Lee

Michelle K. Lee
*Deputy Director of the United States Patent and Trademark Office*